US012553687B2

(12) United States Patent
Kilic

(10) Patent No.: US 12,553,687 B2
(45) Date of Patent: Feb. 17, 2026

(54) WEAPON SIGHT

(71) Applicant: Michael Ali Kilic, Schwebheim (DE)

(72) Inventor: Michael Ali Kilic, Schwebheim (DE)

( * ) Notice: Subject to any disclaimer, the term of this patent is extended or adjusted under 35 U.S.C. 154(b) by 0 days.

(21) Appl. No.: 17/946,290

(22) Filed: Sep. 16, 2022

(65) Prior Publication Data

US 2023/0083029 A1 Mar. 16, 2023

Related U.S. Application Data

(60) Provisional application No. 63/244,961, filed on Sep. 16, 2021.

(51) Int. Cl.
*F41G 1/34* (2006.01)
*F41G 11/00* (2006.01)

(52) U.S. Cl.
CPC ..... *F41G 1/345* (2013.01); *F41G 11/003* (2013.01)

(58) Field of Classification Search
CPC ..... F41G 1/345; F41G 11/003
See application file for complete search history.

(56) References Cited

U.S. PATENT DOCUMENTS 2,529,057 A * 11/1950 Teffault ..... F41G 1/345 362/110
3,914,873 A * 10/1975 Elliott, Jr. ..... F41G 1/345 42/117
4,434,560 A * 3/1984 Comeyne ..... F41G 1/345 42/114
4,651,432 A * 3/1987 Bornancini ..... F41G 1/02 42/133
5,735,070 A * 4/1998 Vasquez ..... F41G 1/345 42/132
6,640,482 B2 * 11/2003 Carlson ..... F41G 1/345 42/132
7,631,433 B2 * 12/2009 Labowski ..... F41G 1/467 124/87
9,212,867 B2 * 12/2015 Patterson ..... H05B 45/12
9,316,461 B1 * 4/2016 Gwillim, Jr. ..... F41G 1/345
9,341,424 B2 * 5/2016 Allan ..... F41A 17/06
9,482,488 B2 * 11/2016 Moyle ..... G02B 6/0008
9,638,492 B2 * 5/2017 Jones ..... F41G 1/01
9,841,254 B2 * 12/2017 Moore ..... F41C 23/22
10,088,275 B1 * 10/2018 Warren ..... F41G 1/02
10,094,638 B2 * 10/2018 Grace, Jr. ..... F41G 1/467
10,180,306 B2 * 1/2019 Ben Zion ..... F41G 1/10
10,197,359 B1 * 2/2019 Toole ..... F41G 1/35
10,209,033 B1 * 2/2019 Moore ..... F41G 1/35
10,837,736 B2 * 11/2020 Marelin ..... F41A 3/66
10,962,314 B2 * 3/2021 Hedeen ..... F41A 9/62
11,029,129 B1 * 6/2021 Lee ..... F41G 1/02
11,287,220 B2 * 3/2022 Grace ..... F41G 1/345
11,421,960 B2 * 8/2022 Sun ..... F41G 1/16
(Continued)

*Primary Examiner* — Michelle Clement
(74) *Attorney, Agent, or Firm* — ATIP Law; Ian Burns

(57) ABSTRACT

A handgun may include a slider-integrated active illumination sight. By integration of electrical connectors into the slider that conduct power from a rear powered sight to a front sight mounting area, a light source inside the front sight can emit light to the shooter's eye and make the front sight visible in any light condition. In combination with actively illuminated rear sight marks, the user now sees three evenly illuminated aiming marks. Alternatively, light can be conveyed from the rear unit to the front aiming marks by means of fiber optics.

21 Claims, 8 Drawing Sheets

(56) References Cited

U.S. PATENT DOCUMENTS

| | | | | |
|---|---|---|---|---|
| 11,466,960 | B2 * | 10/2022 | Noskowicz | F41G 1/38 |
| 11,530,901 | B2 * | 12/2022 | Brewer | F41G 1/065 |
| 11,536,537 | B2 * | 12/2022 | Hanley | F41G 11/001 |
| 11,561,057 | B2 * | 1/2023 | Hedeen | F41C 23/10 |
| 11,761,816 | B2 * | 9/2023 | Sabaldan Elpedes | F41G 1/345 362/23.19 |
| 11,815,333 | B2 * | 11/2023 | Noskowicz | F41G 1/345 |
| 2017/0268842 | A1 * | 9/2017 | Kennair, Jr. | F41A 17/063 |
| 2021/0207928 | A1 * | 7/2021 | Brewer | F41G 11/002 |
| 2023/0064486 | A1 * | 3/2023 | Brewer | F41G 1/065 |
| 2023/0073712 | A1 * | 3/2023 | Chandler | F41A 17/063 |
| 2023/0075844 | A1 * | 3/2023 | Chandler | F41A 17/56 |
| 2023/0119011 | A1 * | 4/2023 | Grace | F41G 1/345 42/116 |
| 2023/0176388 | A1 * | 6/2023 | Parker | G02B 27/0179 359/13 |
| 2023/0185074 | A1 * | 6/2023 | Crispin | F41G 1/38 359/428 |

* cited by examiner

WEAPON SIGHT

CROSS REFERENCE TO RELATED APPLICATIONS

This application claims priority to U.S. provisional patent application Ser. No. 63/244,961, filed 16 Sep. 2021, the contents of which are herein incorporated by reference.

FIELD OF THE INVENTION

The present invention relates to sighting devices used on small arms. More specifically, it relates to illuminated open sights used on handguns or other small arms.

BACKGROUND

Open sights are widely used, which enable the user to aim with the help of a front sight with one circular mark and rear sight with two circular marking points. For better visibility, these target marks can be equipped with bright, reflective, self-illuminated or light-collecting elements.

Open sights have many advantages: they are inexpensive to produce, uncomplicated to use, sturdy, lightweight and resistant to environmental conditions. Over the years, many developments have been made in the art with the goal of developing an illuminated open sight which can be used in low light or night time conditions. An early example is U.S. Pat. No. 2,529,057 granted on Nov. 7, 1950. This patent discloses an illuminated gun sight which uses a small battery-powered electric light bulb. Similarly, U.S. Pat. No. 3,698,092 granted on Oct. 17, 1972 introduces an illuminated open sight that uses light bulbs both in the front sight and in the rear sight. In this patent, the front sight's light source is connected to the rear sight via a wire.

More recent prior art pertaining to this subject include U.S. Pat. No. 6,640,482 issued to Carlson on Nov. 4, 2003. This patent teaches a dual-powered fiber optic sight for guns which can be illuminated either by ambient light or by a light source such as a Light Emitting Diode (LED). Ambient light and light from the LED are carried by a fiber optic rod and the rod appears as a bright dot on the front sight of the gun. In '482, the battery and the electronics are all put inside a single compartment at the front sight. While this is acceptable on a weapon with a long and relatively large barrel, it is not a viable solution for a small weapon such as a handgun.

Another recent prior art is the electronically illuminated open sight introduced in the patent application by Jones (US Pub. No. 2017/0016697 published on Jan. 19, 2017). In '697, LEDs are used to illuminate fiber optic rods positioned within both the front sight and the rear sight. Each fiber optic rod is viewable through a viewing port in the rear surface of its respected housing, making the illuminated fiber optic rods viewable only to the user of the handgun or rifle. The LEDs are housed within the sight body. Fiber optic cables are run from the LEDs to the illuminated rods in order to transfer light from the LEDs to rods which then serve as illuminated aiming marks. While this is an elegant solution, it is not easy to adapt to handguns having different barrel lengths. For different barrel lengths, custom fiber optic cables must be developed to transfer light from the rear sight to the front sight. Furthermore, the exposed fiber optic cables are prone to damage, especially during holstering.

It is evident from the above review of the state of the art that there is a need for an improved compact and illuminated open sight that can be readily mounted onto handguns.

SUMMARY OF ONE EMBODIMENT OF THE INVENTION

Advantages of One or More Embodiments of the Present Invention

The various embodiments of the present invention may, but do not necessarily, achieve one or more of the following advantages:

- provide a compact sight with active illuminated front and rear sights;
- provides a means to conduct power from a single battery to both front and rear sights;
- provide a means to protect a conductor extending between the front and rear sights; and
- provide an illuminated sight that can be fitted to weapons of varying barrel lengths.

These and other advantages may be realized by reference to the remaining portions of the specification, claims, and abstract.

Brief Description of One Embodiment of the Present Invention

This invention teaches a slider-integrated active illumination sight. By integration of electrical connectors into the slider, a light source inside the front sight can emit light to the shooter's eye and make the front sight visible in any light condition. In combination with actively illuminated rear sight marks, the user now sees three evenly illuminated aiming marks. Alternatively, light can be conveyed from the rear unit to the front aiming marks by means of fiber optics.

In one aspect, there is provided a slider for a handgun comprising a rear sight mounting area for mounting a rear sight and a front sight mounting area for mounting a front sight. The slider may include at least one port passing through a body of the slider for conveying a conductor from an internal body of the slider to at least one of the front sight mounting area or the rear sight mounting area.

In one aspect, there is provided a slider for a handgun comprising a slider body. A front active illuminated sight may be mounted at a front mounting area on an outside of the slider body. A rear active illuminated sight may be mounted at a rear mounting area on the outside of the slider body. At least one conductor may extend between the front active illuminated sight and the rear illuminated sight, the at least one conductor being disposed within the body of the slider.

In one aspect, there is provided a handgun comprising a slider. The slider may comprise a slider body. A front active illuminated sight may be mounted at a front mounting area on an outside of the slider body. A rear active illuminated sight may be mounted at a rear mounting area on the outside of the slider body. At least one conductor may extend between the front active illuminated sight and the rear illuminated sight, the at least one conductor being disposed within the body of the slider.

In one aspect, there is provided a slider for a handgun. The slider may comprise slider body means, front active illuminated sight means mounted at a front mounting area on an outside of the slider body means and rear active illuminated sight means mounted at a rear mounting area on the outside of the slider body means. Conductor means may extend between the front active illuminated sight means and the rear illuminated sight means, the conductor means being disposed within the slider body means.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

FIG. 6A shows a red aiming mark display mode with red dot optics off;

FIG. 6B shows the red aiming mark display mode with red dot optics on;

FIG. 6C shows a green aiming mark display mode with red dot optics off;

FIG. 6D shows a green aiming mark display mode with the red dot optics removed;

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

A slider-integrated active illumination sight will be described herein. By integration of electrical connectors into the slider, a light source inside the front sight can emit light to the shooter's eye and make the front sight visible in any light condition. In combination with actively illuminated rear sight marks, the user now sees three evenly illuminated aiming marks. Alternatively, light can be conveyed from the rear unit to the front aiming marks by means of fiber optics.

Figure 1:
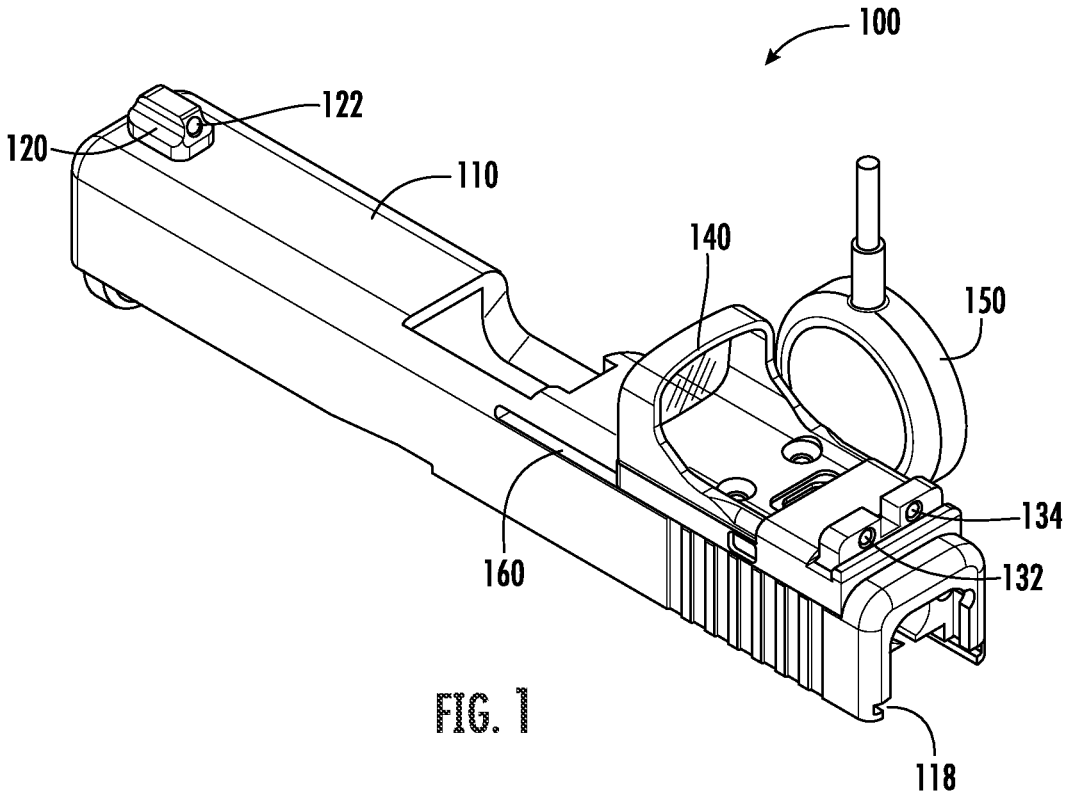
FIG. 1 is substantially a perspective view of a slider have front and rear active illumination sights in accordance with an embodiment of the invention.
Figure 7:
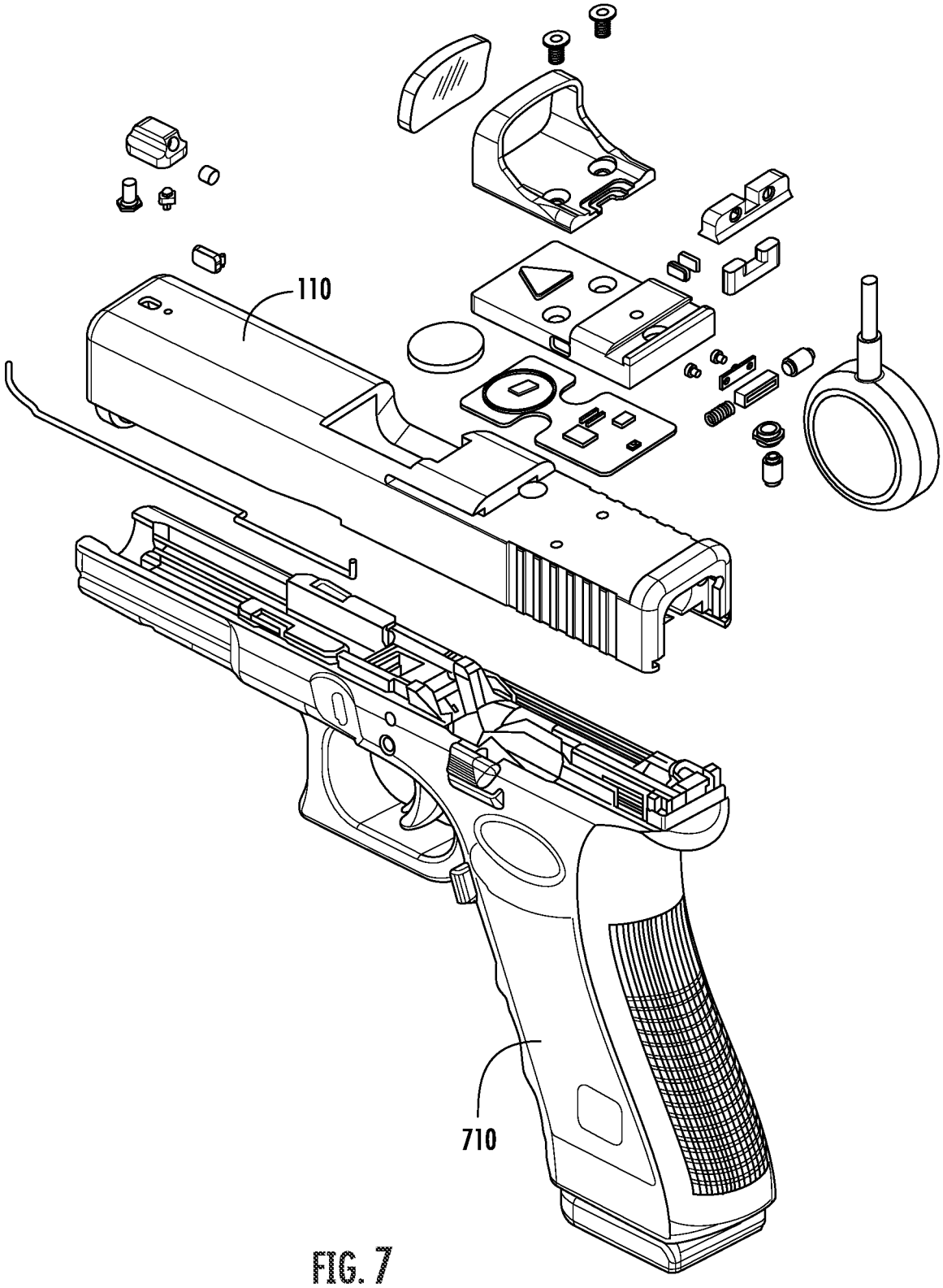
FIG. 7 substantially shows the exploded view of the slider of FIG. 2 in conjunction with a handgun body.

FIG. 1 shows an embodiment of a slider 100 for a handgun. The slider 100 features a weapon slide 110 that can be mounted as part of a handgun. The particular shape and configuration of the weapon slide will be dependent on the mechanism of the underlying handgun and thus the shape of the slide 110 may take different forms in different embodiments. By way of example, the slider 100 will include features such as groove 118 that is able to engage with a complementary rib or other projection on the handgun body for mounting the slider onto the handgun. Stops and limiters control the range of movement between the slider and the handgun body. Further components as shown in FIG. 7 allow for movement of the slider on the handgun body to cause autoloading, including expulsion of a spent shell and chambering of a new round, as is known in the art. The particular slider illustrated in FIG. 1 may be considered generic across a range of handguns.

On the top of the weapon slide 110 at a front end of the slide 110 is a front illuminated sight 120 having a front sight mark 122. On top of a rear end of the slide is a rear illuminated sight 130 having a pair of rear sight marks 132, 134. The front sight mark is substantially centrally located on a longitudinal axis of the weapon slide 110. The rear sight marks 132, 134 are substantially equally spaced either side of the longitudinal axis of the front illuminated sight 110 and a rear illuminated sight 120. Thus, when viewed along the longitudinal axis of the slider, the front aiming mark 122 will appear between the rear aiming marks 132, 134.

The rear sight 130 may optionally include red dot optics 140. The red dot optics may be detachable.

The rear sight 130 may optionally be charged by an inductive charging unit (ICU) 150 or an alternative wireless charging system.

A connector element 160 including a conductor may be disposed within the body of the weapon slide 110 and extend between the rear sight 130 and the front sight 120. The conductor may be an electrical conductor or a light conductor, such as an optical fiber.

Figure 2:
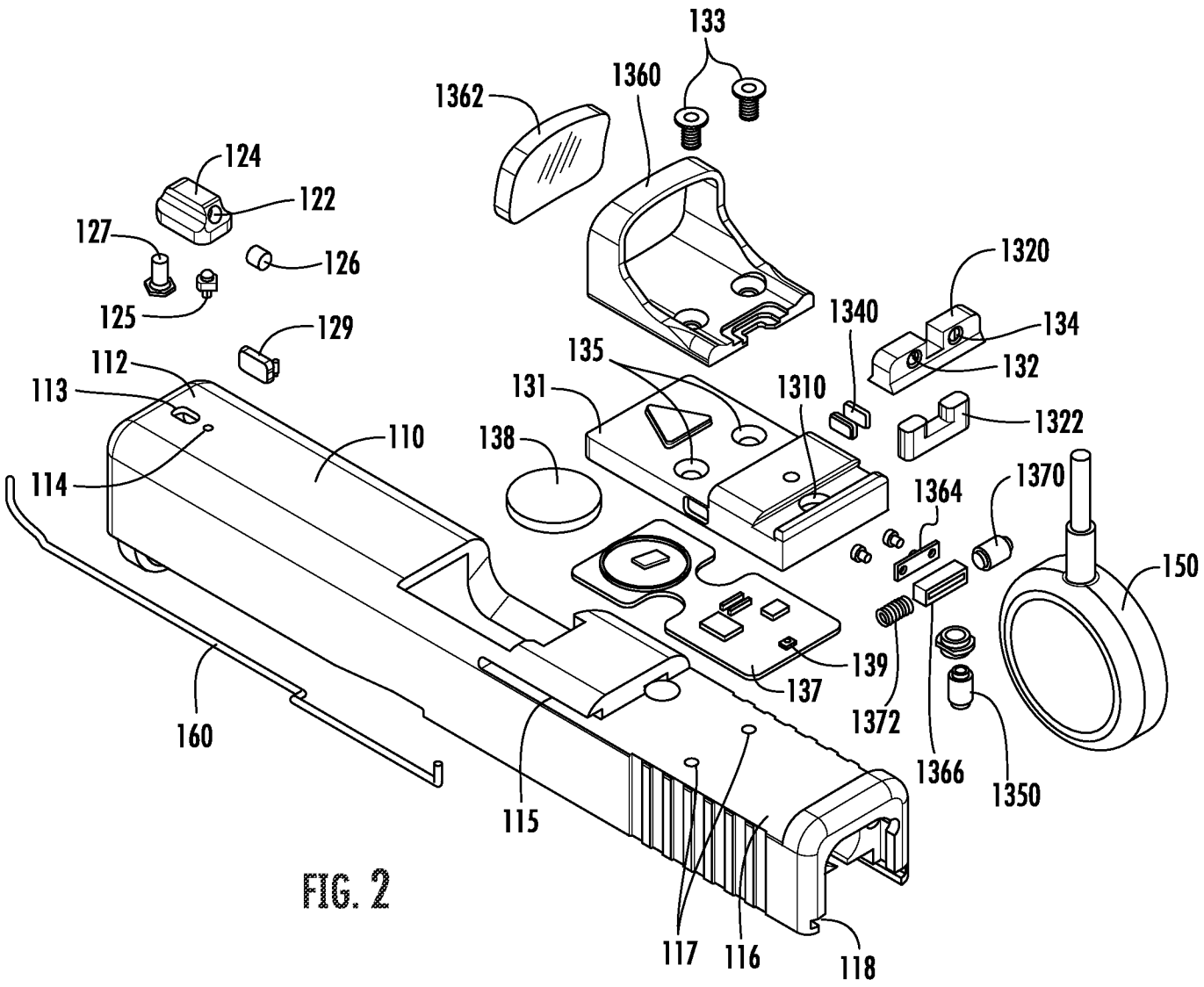
FIG. 2 is substantially an exploded view of the slider of FIG. 1.

FIG. 2 shows an exploded view of the elements of FIG. 1. The slider 110 includes a front sight mounting area 112 on a top surface of the slider 110 adjacent the front end of the slider. The front sight mounting area 112 includes a screw hole 113 for mounting the front sight 120. A front connector port 114 is also provided in the front sight mounting area 112. The front connector port 114 provides a conduit for the connector element to 160 to convey power and/or light to the front sight 120. The slider 110 also includes a rear sight mounting area 116 adjacent a rear end of the slide 110. The rear sight mounting area 116 includes a plurality of threaded screw holes 117 for mounting the rear sight 130.

The front sight 120 includes a front sight housing 124 that houses a front LED 125. A light diffuser 126 may be disposed in the front sight aiming mark 122. A front sight fastener, such as a screw 127 may mount the front sight housing 124 to the front sight mounting area 112 through the screw hole 113. The front LED 125 is mounted within the housing 124 such that light emitted by the front LED 125 is diffused through the diffuser 126 and projected rearward through the front sight mark 122. The LED 125 thus illuminates the front sight mark 122.

The front sight 120 may optionally include a thermocouple 129 that generates electricity from heat generated through operation of the handgun. The thermocouple 129 may conduct the electricity to the LED 125.

The rear sight 130 includes a rear sight housing 131 including screw holes 135 that enable the housing 131 and rear sight components to be mounted to the rear sight mounting area 116 by screws 133 into the threaded screw holes 117 of the rear sight mounting area 116.

Within the housing 131 there may be an electronics PCB 137 and a battery 138. The battery 138 may be a rechargeable and/or replaceable lithium ion battery. In one embodiment, the battery 138 may be able to be inductively charged. The PCB 137 may control the functions of the sight and may include components for near-field communications, including BLUETOOTH™. The PCB 137 may also include sensors such as motion sensors, recoil sensors, usage sensors, etc. These sensors can detect discharge of the handgun and be used to maintain a shooter's log within the PCB. The PCB may also include controls for date and time setting, as well as controls for adjusting the LEDs. The PCB also directly supports the rear LED 139 that provides the light source for the rear aiming marks 132, 134.

The rear LED 139 projects through a hole 1310 in the housing 134. An aiming mark housing 1320 is received within a groove of the housing 134 that is disposed above the rear LED 139. The aiming mark housing 1320 contains the aiming marks 132, 134 and houses a diffuser 1322. The diffuser 1322 receives light from the rear LED 139 and conducts it to the aiming marks 132, 134. Thus, the rear LED 139 simultaneously illuminates both of the rear aiming marks 132, 134.

On a side of the rear sight housing 134 there may be buttons 1340 that connect to the PCB 137 and allow for control of the functions of the sight.

As stated above, the sight may optionally include red dot optics. The red dot optics may include a detachable red dot housing 1360 that includes red dot glass 1362. The red dot glass 1362 will typically have zero parallax, as is known in the art. A red dot LED 1364 may be mounted on a diode holder 1366. The red dot LED 1364 projects a red dot onto the red dot glass 1362. A vertical adjustment screw 1350 may control the vertical adjustment of the diode holder 1366. Similarly, a horizontal adjustment screw 1370 can adjust the horizontal position of the diode holder 1366 against the action of a spring 1372.

In one embodiment, the connector element 160 may be a FFC type flexy cable. Each end of the connector element 160 may include a FFC type connector that enables a simple plug and lock connector to the PCB 137 at one end and the front LED 125 at the other end.

In one embodiment, a channel may be provided within the slider 110 to accommodate the connector 160. A conduit or passage 115 between the upper side of the slider 110 and the underside of the slider body may convey the connector 160 through the slider body to the channel. The connector 160 may first be connected to the PCB 137 board via an FFC cable plug. The connector may then be placed through the conduit 115 and into the channel inside the gun slider and connected to the front LED 125 at the front end of the slider. The channel may be covered with a heat resistant glue, epoxy, etc. that secures the connecter 160 in place so that all connector surfaces are covered and fixed to the slider body, making the connector heat, water and shooting resistant. While a specifically provisioned channel is described, alternatively, the connector 160 may be secured to an inside surface of the slider 110.

Figure 3:
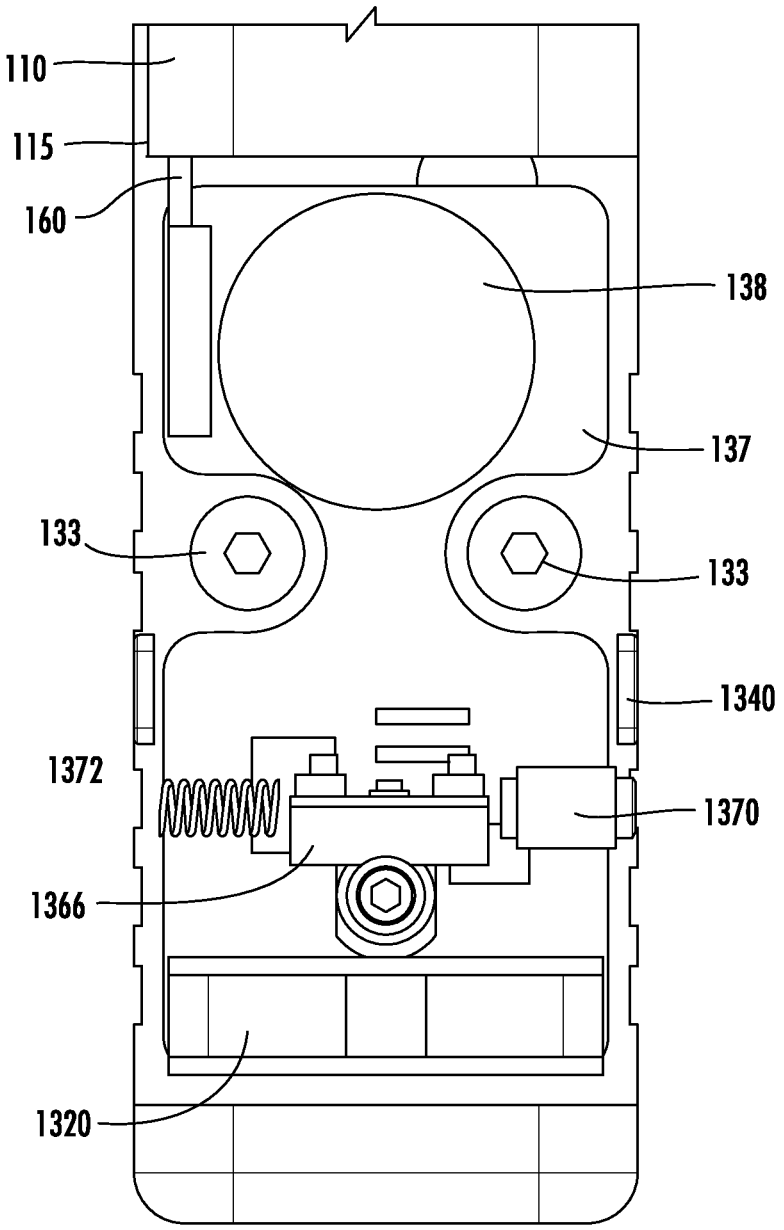
FIG. 3 is substantially a top view of a rear illuminated sight with a housing removed.

FIG. 3 shows a top view of the rear sight 130 mounted on the slider 110 with the housing 134 removed, thus showing the assembly and configuration of the internal components. FIG. 3 also shows the connector element 160 connected to the PCB 137 and then extending forward into the body of the slider 110.

Figure 4:
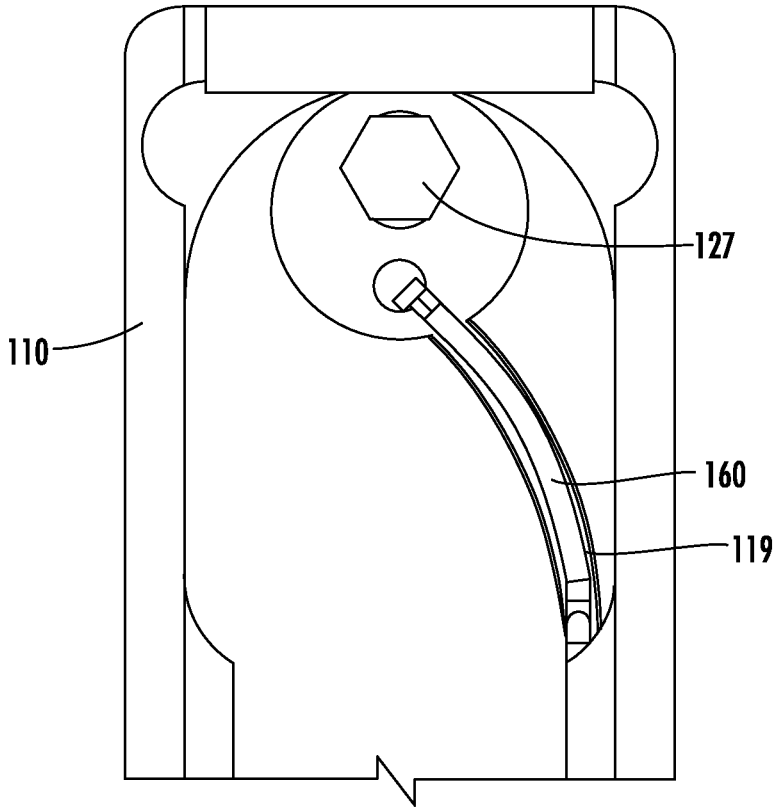
FIG. 4 is substantially an underneath view of a front end of a slider body showing a conductor channel.

FIG. 4 shows an underside view of a front portion of the slider 110. FIG. 4 shows the connector 160 secured within a channel 119 of the slider 100. The channel may be an open channel or groove that allows the connector 160 to be laid in the channel. Alternatively, the channel may be a closed channel or conduit which requires the connector 160 to be fed through the channel from one end to the other. The connector extends to the front connector port 114. The terminals of the front LED 125 protrude through the port 114 to connect to the end of the connector 160.

FIG. 4 also shows the base of the screw 127 that secures the front sight 120 to the front sight mounting area.

Figure 5:
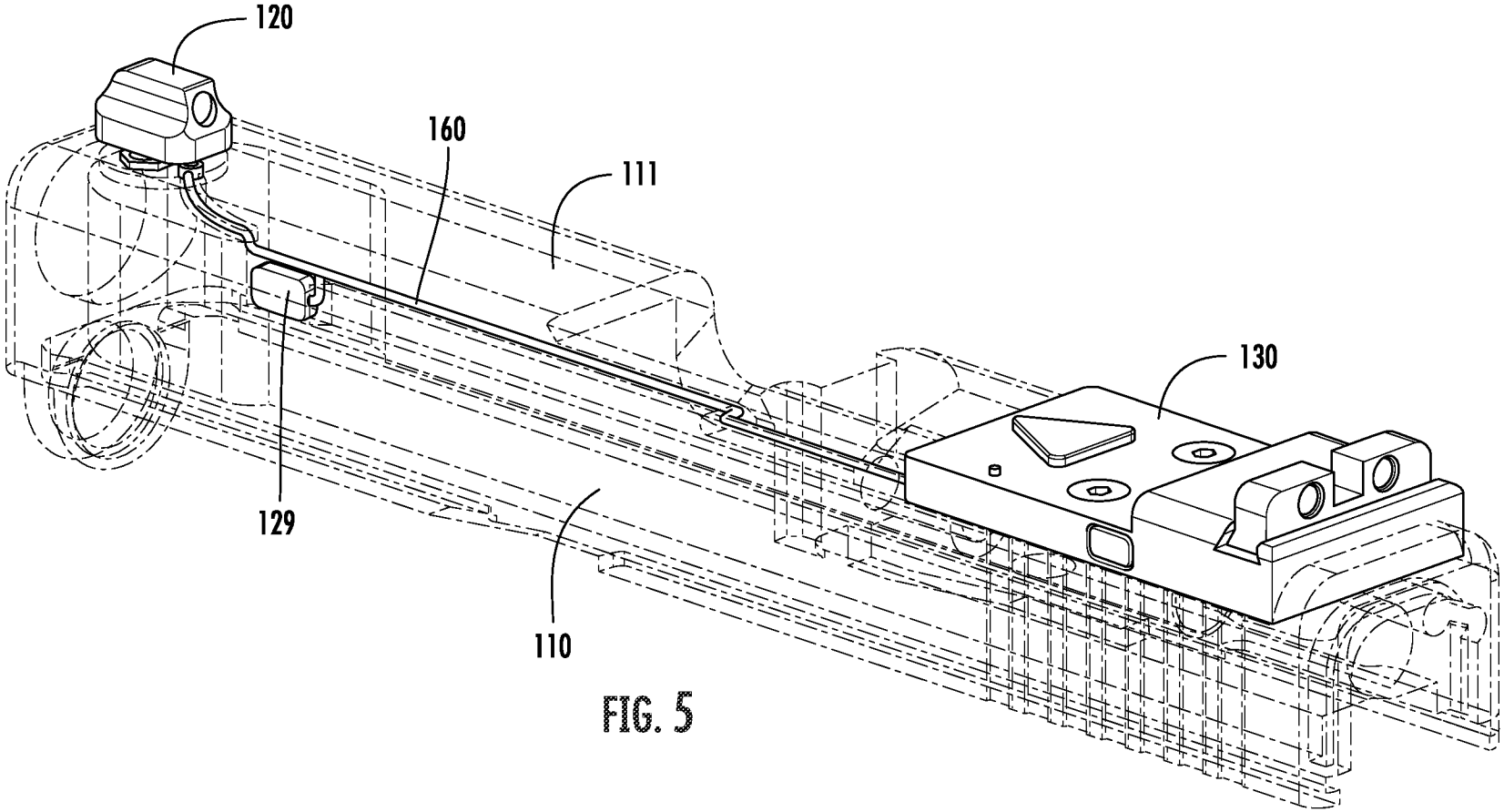
FIG. 5 is substantially a ghosted view of the slider showing the internal conductor.

FIG. 5 shows the slider 100 with the red dot optics removed and the slider in ghosted outline to show the internal passage of the connector 160 within the body of the slider 110. The connector 160 extends under the top surface 111 of the slider. FIG. 5 also shows the location of the thermocouple 129. The thermocouple 129 may be located to absorb maximum heat from the barrel after discharge of the handgun and provide energy into the electrical conductors of the connector element 160.

Figures 6A, 6B, 6C, 6D:
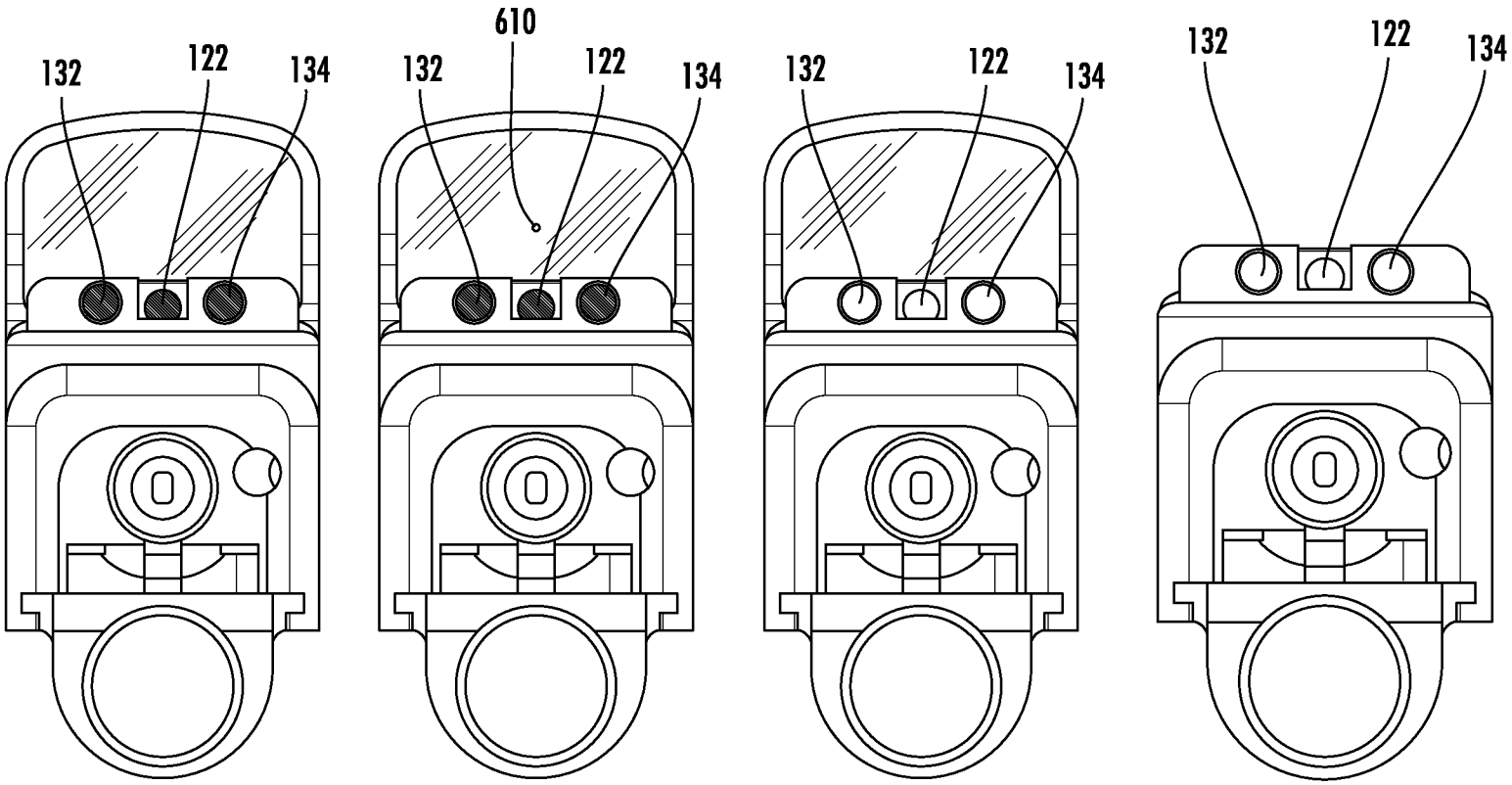

FIGS. 6A-6D show some of the available sighting options provided by the sight of the present embodiments. FIG. 6A shows the sight with the red dot optics attached but in an off mode and the aiming marks in a first color (red) display mode. FIG. 6B shows the red dot optics in an on mode so that a red dot 610 appears on the red dot glass 1362. The LEDs of both the front and rear sights may have multiple color modes. By toggling the controls through buttons 1340, the user can change the display color of the LEDs. FIG. 6C shows the sight operating in a second color (green) display mode. FIG. 6D shows the sight in a green display mode after removal of the red dot optics.

The PCB 137 may include one or more processors and one or more memories operatively associated with the processors. The processors may be programmed for a variety of functions including, without limitations, motion detection, position detection, controlling the light intensity, processing the sensor data, wireless connectivity, date and time functions, smart charging functions. The memories may store user settings, including preferred light intensities, shooting logs, etc.

As described above and shown in FIGS. 1 and 2, the sight may include an ICU 150 that allows for wireless charging of the battery 138. The ICU 150 is a separate component and may be located on or in a holster or similar so that the ICU may charge the sight during non-use of the handgun.

Figure 8:
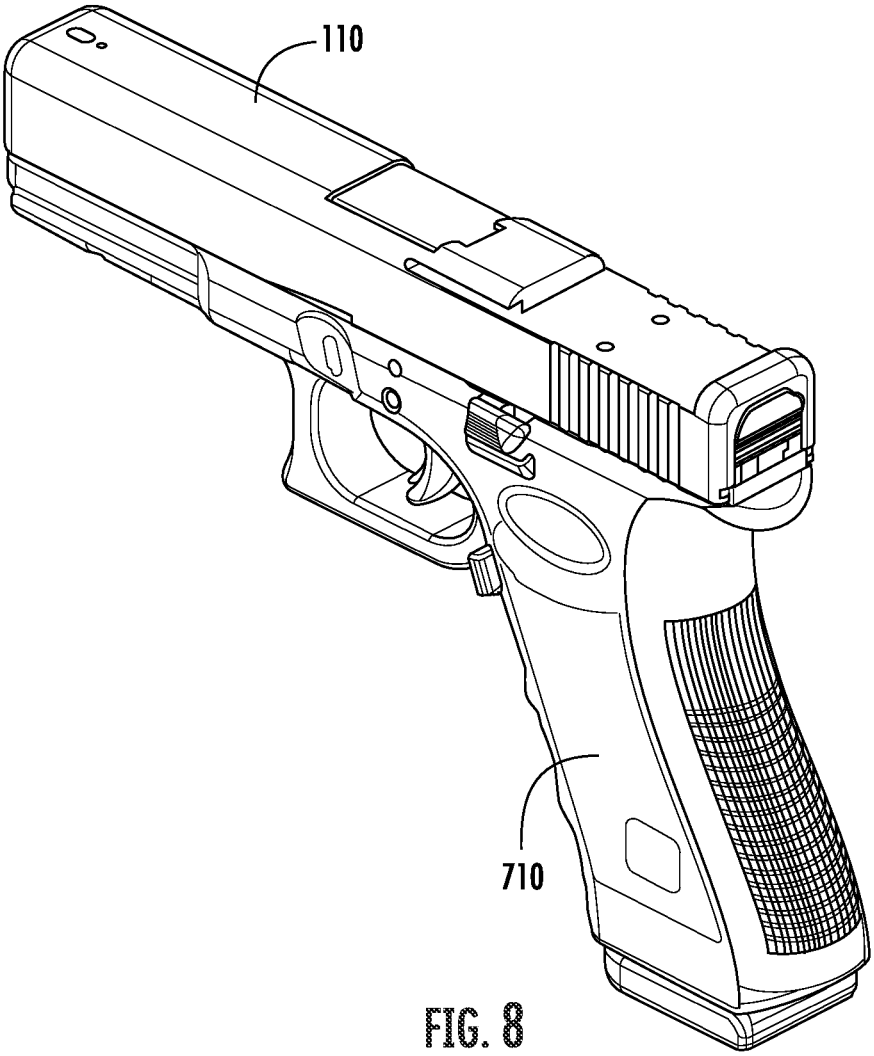
FIG. 8 substantially shows a slide in accordance with an embodiment of the invention mounted to a handgun body.

FIG. 7 shows the exploded view of the slide 110 and sighting system of FIG. 2 in conjunction with a suitable handgun 710. FIG. 8 shows an embodiment of the handgun 710 with slide 110 attached in preparation for mounting a sighting system herein. In the embodiment of FIG. 8, the connector 160 may already be provided within the slider body 110, ready for electrically and/or optically mounting the sight components.

In the embodiments described, the battery unit is provided in the rear sight and power is conducted forward from the rear unit to the front unit to power the diode of the front sight. This embodiment is considered preferable for balance and stability of the handgun because it reduces the cantilevered weight of the handgun. However, in an alternative embodiment, the front sight may incorporate the battery unit with power being conducted to the rear unit.

In the embodiments described and illustrated, the front sight includes an LED that is powered by current transmitted through the connector element. In an alternative embodiment, the connector element may include an optical conductor such as a fiber optic cable. The light source for the front sight may be provided in the rear. That is, the front sight may omit the LED 125 and instead, light may be conducted through the connector element to the front sight for projection rearward from the front sight.

Although the description above contains many specifications, these should not be construed as limiting the scope of the invention but as merely providing illustrations of some of the embodiments of this invention. Thus, the scope of the invention should be determined by the appended claims and their legal equivalents rather than by the examples given.

What is claimed is:

1. A slider for a handgun comprising:

(A) a slider body;

(B) a front active illuminated sight mounted at a front mounting area on an outside of the slider body;

(C) a rear active illuminated sight mounted at a rear mounting area on the outside of the slider body;

(D) at least one conductor extending between the front active illuminated sight and the rear illuminated sight, the at least one conductor being disposed within the body of the slider;

(E) a thermocouple that generates electricity from heat and conducts generated electricity to the at least one conductor.

2. The slider of claim 1 comprising a front port passing through the front sight mounting area for allowing connection between a front end of a conductor and a light emitting component.

3. The slider of claim 2 wherein the light emitting component comprises a light emitting diode.

4. The slider of claim 1 comprising a channel in the slider body for receiving and guiding the at least one conductor between the front sight mounting area and the rear sight mounting area.

5. The slider of claim 1 wherein the rear illuminated sight comprises red dot optics.

6. The slider of claim 1 wherein the at least one conductor comprises an electrical conductor.

7. The slider of claim 1 wherein the at least one conductor comprises an optical conductor.

8. The slider of claim 1 wherein at least one of the front active illuminated sight and the rear active illuminated sight comprises an electronics unit comprising a battery capable of inductive charging.

9. A handgun comprising:

(A) a slider comprising a slider body;

(B) a front active illuminated sight mounted at a front mounting area on an outside of the slider body;

(C) a rear active illuminated sight mounted at a rear mounting area on the outside of the slider body;

(D) a connector comprising at least one conductor extending between the front active illuminated sight and the rear illuminated sight, the connector being disposed within the slider body;

(E) a thermocouple that generates electricity from heat generated through operation of the handgun and conducts generated electricity to the at least one conductor.

10. The handgun of claim 9 comprising a front port passing through the front sight mounting area for allowing connection between a front end of a conductor and a light emitting component.

11. The slider of claim 10 wherein the light emitting component comprises a light emitting diode.

12. The slider of claim 9 comprising a channel in the slider body for receiving and guiding the at least one conductor between the front sight mounting area and the rear sight mounting area.

13. The slider of claim 9 wherein the rear illuminated sight comprises red dot optics.

14. The slider of claim 9 wherein the at least one conductor comprises an electrical conductor.

15. The slider of claim 9 wherein the at least one conductor comprises an optical conductor.

16. The slider of claim 9 wherein at least one of the front active illuminated sight and the rear active illuminated sight comprises an electronics unit comprising a battery capable of inductive charging.

17. A slider for a handgun comprising:

(A) slider body means;

(B) front active illuminated sight means mounted at a front mounting area on an outside of the slider body means;

(C) rear active illuminated sight means mounted at a rear mounting area on the outside of the slider body means;

(D) conductor means extending between the front active illuminated sight means and the rear illuminated sight means, the conductor means being disposed within the slider body means;

(E) thermocouple means that generates electricity from heat generated through operation of the handgun and conducts generated electricity to the conductor means.

18. The slider of claim 17 comprising front port means passing through the front sight mounting area for allowing connection between a front end of the conductor means and light emitting means.

19. The slider of claim 17 comprising channel means in the slider body means for receiving and guiding the conductor means between the front sight mounting area and the rear sight mounting area.

20. The slider of claim 17 wherein the rear illuminated sight means comprises red dot optics means.

21. The slider of claim 17 wherein at least one of the front active illuminated sight means and the rear active illuminated sight means comprises an electronics unit comprising battery means capable of inductive charging.

* * * * *